US006181647B1

(12) United States Patent
Tipton et al.

(10) Patent No.: US 6,181,647 B1
(45) **Date of Patent: *Jan. 30, 2001**

(54) VERTICAL JUMP MEASURING DEVICE

(75) Inventors: Steven M. Tipton; Matt Hackworth; Kelly Willson, all of Tulsa, OK (US)

(73) Assignee: The University of Tulsa, Tulsa, OK (US)

( * ) Notice: Under 35 U.S.C. 154(b), the term of this patent shall be extended for 0 days.

This patent is subject to a terminal disclaimer.

(21) Appl. No.: 09/192,970

(22) Filed: Nov. 16, 1998

Related U.S. Application Data

(63) Continuation-in-part of application No. 08/797,395, filed on Feb. 10, 1997, now Pat. No. 5,838,638.

(51) Int. Cl.[7] ..... G04B 47/00; G04F 8/00; A63B 23/00

(52) U.S. Cl. ..... 368/10; 368/110; 482/8; 482/15

(58) Field of Search ..... 368/10, 12, 109, 368/113; 36/132, 136, 137, 114; 482/1, 8, 79, 909, 901, 902; 73/379.01, 379.04, 379.06

(56) References Cited

U.S. PATENT DOCUMENTS

| | | | | |
|---|---|---|---|---|
| 3,795,396 | | 3/1974 | Kropelnitski | 272/59 |
| 4,208,050 | | 6/1980 | Perrine et al. | 273/1.5 |
| 4,323,234 | | 4/1982 | Glaese | 272/93 |
| 4,932,137 | | 6/1990 | Haley et al. | 33/700 |
| 5,031,903 | | 7/1991 | Clarke | 272/93 |
| 5,125,647 | | 6/1992 | Smith | 482/8 |
| 5,229,981 | | 7/1993 | Maschi | 368/111 |
| 5,260,870 | | 11/1993 | Tsuchiya et al. | 364/413 |
| 5,343,445 | | 8/1994 | Cherdak | 368/10 |
| 5,349,569 | | 9/1994 | Tanaka | 368/10 |
| 5,363,146 | * | 11/1994 | Flentov et al. | 368/10 |
| 5,401,224 | | 3/1995 | Tsuchiya et al. | 482/8 |
| 5,452,269 | | 9/1995 | Cherdak | 368/10 |
| 5,471,405 | | 11/1995 | Marsh | 364/556 |
| 5,511,045 | | 4/1996 | Sasaki et al. | 368/2 |
| 5,838,638 | * | 11/1998 | Tipton et al. | 368/10 |

* cited by examiner

*Primary Examiner*—Vit Miska
*Assistant Examiner*—Jeanne-Marguerite Goodwin
(74) *Attorney, Agent, or Firm*—Head, Johnson & Kachigian

(57) ABSTRACT

A method to measure height of a vertical jump of a jumper. At least one switch is deactivated by the jumper stepping thereon. The switch is initially activated by the jumper jumping upward therefrom and thereafter deactivated upon return. A time period is measured while the switch is activated. The square of the activated time period is calculated and thereafter the result is multiplied by a constant to derive vertical jump height. Finally, the resultant vertical jump height of the jump is displayed.

10 Claims, 5 Drawing Sheets

Fig. 10

| time | height |
|---|---|
| 0.01 | 0.00482625 |
| 0.02 | 0.019305 |
| 0.03 | 0.04343625 |
| 0.04 | 0.07722 |
| 0.05 | 0.12065625 |
| 0.06 | 0.173745 |
| 0.07 | 0.23648625 |
| 0.08 | 0.30888 |
| 0.09 | 0.39092625 |
| 0.1 | 0.482625 |
| 0.11 | 0.58397625 |
| 0.12 | 0.69498 |
| 0.13 | 0.81563625 |
| 0.14 | 0.945945 |
| 0.15 | 1.08590625 |
| 0.16 | 1.23552 |
| 0.17 | 1.39478625 |
| 0.18 | 1.563705 |
| 0.19 | 1.74227625 |
| 0.2 | 1.9305 |
| 0.21 | 2.12837625 |
| 0.22 | 2.335905 |
| 0.23 | 2.55308625 |
| 0.24 | 2.77992 |
| 0.25 | 3.01640625 |
| 0.26 | 3.262545 |
| 0.27 | 3.51833625 |
| 0.28 | 3.78378 |
| 0.29 | 4.05887625 |
| 0.3 | 4.343625 |
| 0.31 | 4.63802625 |

| time | height |
|---|---|
| 0.32 | 4.94208 |
| 0.33 | 5.255786 |
| 0.34 | 5.579145 |
| 0.35 | 5.912156 |
| 0.36 | 6.25482 |
| 0.37 | 6.607136 |
| 0.38 | 6.969105 |
| 0.39 | 7.340726 |
| 0.4 | 7.722 |
| 0.41 | 8.112926 |
| 0.415 | 8.312009 |
| 0.42 | 8.513505 |
| 0.425 | 8.717414 |
| 0.43 | 8.923736 |
| 0.435 | 9.132472 |
| 0.44 | 9.34362 |
| 0.445 | 9.557182 |
| 0.45 | 9.773156 |
| 0.455 | 9.991544 |
| 0.46 | 10.21235 |
| 0.465 | 10.43556 |
| 0.47 | 10.66119 |
| 0.475 | 10.88923 |
| 0.48 | 11.11968 |
| 0.485 | 11.35255 |
| 0.49 | 11.58783 |
| 0.495 | 11.82552 |
| 0.5 | 12.06563 |
| 0.505 | 12.30814 |
| 0.51 | 12.55308 |
| 0.515 | 12.80042 |

| time | height |
|---|---|
| 0.52 | 13.05018 |
| 0.525 | 13.30235 |
| 0.53 | 13.55694 |
| 0.535 | 13.81393 |
| 0.54 | 14.07335 |
| 0.545 | 14.33517 |
| 0.55 | 14.59941 |
| 0.555 | 14.86606 |
| 0.56 | 15.13512 |
| 0.565 | 15.4066 |
| 0.57 | 15.68049 |
| 0.575 | 15.95679 |
| 0.58 | 16.23551 |
| 0.585 | 16.51663 |
| 0.59 | 16.80018 |
| 0.595 | 17.08613 |
| 0.6 | 17.3745 |
| 0.605 | 17.66528 |
| 0.61 | 17.95848 |
| 0.615 | 18.25408 |
| 0.62 | 18.55211 |
| 0.625 | 18.85254 |
| 0.63 | 19.15539 |
| 0.635 | 19.46065 |
| 0.64 | 19.76832 |
| 0.645 | 20.07841 |
| 0.65 | 20.39091 |
| 0.655 | 20.70582 |
| 0.66 | 21.02315 |
| 0.665 | 21.34288 |
| 0.67 | 21.66504 |

| time | height |
|---|---|
| 0.675 | 21.9896 |
| 0.68 | 22.31658 |
| 0.685 | 22.64597 |
| 0.69 | 22.97778 |
| 0.695 | 23.31199 |
| 0.7 | 23.64863 |
| 0.705 | 23.98767 |
| 0.71 | 24.32913 |
| 0.715 | 24.673 |
| 0.72 | 25.01928 |
| 0.725 | 25.36798 |
| 0.73 | 25.71909 |
| 0.735 | 26.07261 |
| 0.74 | 26.42855 |
| 0.745 | 26.78689 |
| 0.75 | 27.14766 |
| 0.755 | 27.51083 |
| 0.76 | 27.87642 |
| 0.765 | 28.24442 |
| 0.77 | 28.61484 |
| 0.775 | 28.98766 |
| 0.78 | 29.36291 |
| 0.785 | 29.74056 |
| 0.79 | 30.12063 |
| 0.795 | 30.50311 |
| 0.8 | 30.888 |
| 0.805 | 31.27531 |
| 0.81 | 31.66503 |
| 0.815 | 32.05716 |
| 0.82 | 32.45171 |
| 0.825 | 32.84866 |

| time | height |
|---|---|
| 0.83 | 33.24804 |
| 0.835 | 33.64982 |
| 0.84 | 34.05402 |
| 0.845 | 34.46063 |
| 0.85 | 34.86966 |
| 0.855 | 35.28109 |
| 0.86 | 35.69495 |
| 0.865 | 36.11121 |
| 0.87 | 36.52989 |
| 0.875 | 36.95098 |
| 0.88 | 37.37448 |
| 0.885 | 37.8004 |
| 0.89 | 38.22873 |
| 0.895 | 38.65947 |
| 0.9 | 39.09263 |
| 0.905 | 39.52819 |

VERTICAL JUMP MEASURING DEVICE

CROSS REFERENCE TO RELATED APPLICATIONS

The present invention is a continuation-in-part of U.S. patent application Ser. No. 08/797,395 filed Feb. 10, 1997 entitled PORTABLE JUMP MEASURING DEVICE, now U.S. Pat. No. 5,838,638.

BACKGROUND OF THE INVENTION

1. Field of the Invention

The present invention is directed to a device to measure the vertical jump height of an athlete. In particular, the present invention is directed to a jump height vertical measuring device which will compute the time period that the jumper's feet are off the floor during a jump and convert that time period to a vertical jump height measurement.

2. Prior Art

Measuring the vertical jump height of an athlete is a test performed by athletic coaches and evaluators around the world. It tells how much power the athlete can exert from his or her legs and also gives a general idea about the jumping potential of the athlete. While vertical jump height is most often associated with the sport of basketball, it is also pertinent to other sports, such as football.

In the past, one method of measuring vertical jump height involved a large movable frame having a series of shims extending from the frame side. The athlete would zero the fixture to his or her body and then knock away as many shims as possible while jumping. The knocked-away shims would indicate the vertical jump of the athlete. This procedure would be prone to cheating if the zeroing phase were not accurate. Additionally, the fixture was typically not portable. Additionally, oftentimes the height indication would be 8 to 12 feet above floor level and, therefore, not conveniently observed.

Additionally, in the past, a shoe has been modified as shown in Cherdak (U.S. Pat. Nos. 5,343,445; 5,452,269) to include a timer device within the shoe. The timer device would measure the "hang time" and not the vertical jumping height. Moreover, the timing device is a part of and within the athletic shoe and is not conducive to testing many athletes quickly.

Various other timing devices are well known, such as swim racing timers. One example is shown in Tenaka(SP) (U.S. Pat. No. 5,349,569).

It is known that when an object is set into vertical upward motion, its position can be described using Newtonian physics. Mathematical relations may be derived to relate the maximum height the object reaches and the time of the motion. These equations may be simple or complex, depending upon the assumptions made during their derivation (wind resistance, local distance to earth's center, stiffness of shoes, etc.). Moreover, empirical relations may be established between time of motion and jump height by observing data from experiments where jump height and time are both measured and plotted against each other.

By measuring the total time period of the jump, a vertical jump height can be derived.

It is, therefore, an object and purpose of the present invention to provide a portable or heavy-duty, vertical jump measuring device which will measure the vertical jump height of a jumper.

It is a further object and purpose of the present invention to provide a portable or heavy-duty, vertical jump measuring device which will calculate the time period of a jump and convert the time period into a vertical jump height measuring.

It is a further object and purpose of the present invention to provide a vertical jump measuring device which is portable and lightweight.

It is a further object and purpose of the present invention to provide a vertical jump measuring device that may be used to obtain measurements quickly and thereafter to reset for additional measurements.

It is a further object and purpose of the present invention to measure the force of the jumper upon take-off and landing as well as the time period of the jump and convert those measurements into vertical jump height.

SUMMARY OF THE INVENTION

The present invention is directed to a vertical jump measuring device for measuring the vertical jump height of a jumper.

In one embodiment, the device includes a portable mat which is both lightweight and easy to transport. Embedded within the mat are one or more proximity transducers which are wired to sense the contact of the jumper's feet with the device or with the ground near the device.

When the feet make or break contact with the transducer, a voltage change occurs and is used to start and stop a timer, which is connected to a microprocessor which is, in turn, connected to a display and controller. Power to the circuit may be in the form of battery power. Alternatively, power may be provided by alternating current wired to a transformer to convert to low voltage direct current.

To measure vertical jump height, the jumper will start with both feet on the mat in a standing, upright position. This serves to establish a datum for the proximity transducer. The jumper will first bend his or her knees and lower the body. The jumper will thereafter jump to his or her maximum height and, then, by force of gravity, return to the mat. When the jumper's feet leave the ground, the signal is used to start the timer. When the jumper's feet return to the mat, the signal is used to stop the timer. The measured time period is taken to represent the period the jumper is in the air. This measured "hang time" is used to compute the jump height by any number of equations or by recalling a specific height associated with specific measured time intervals.

BRIEF DESCRIPTION OF THE DRAWINGS

FIG. 10 illustrates an example of a table that might be employed in alternate configuration of the present invention.

DETAILED DESCRIPTION OF THE PREFERRED EMBODIMENTS

Figure 1:
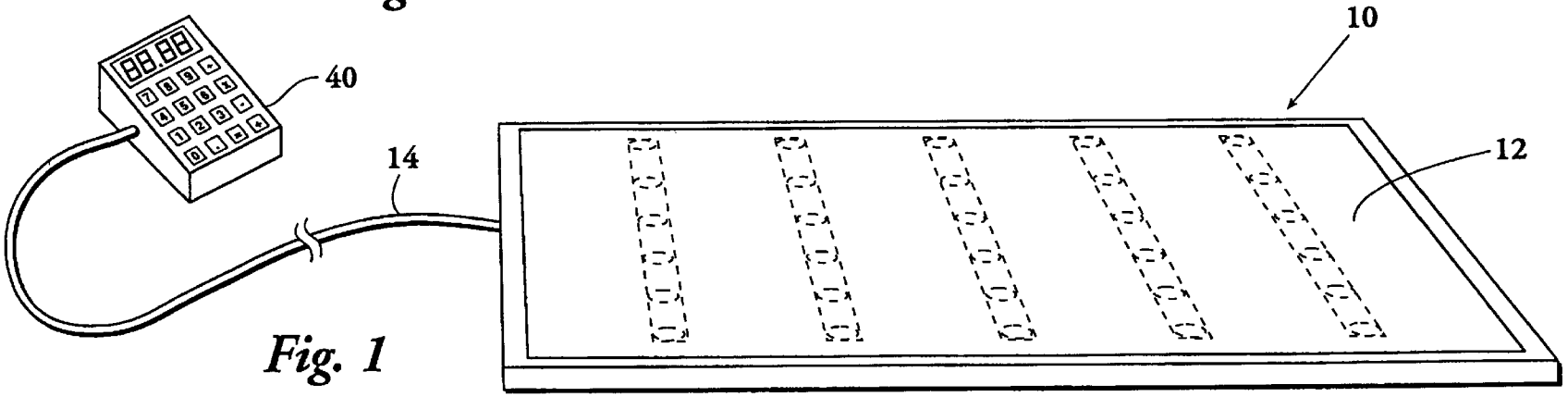
FIG. 1 is a perspective view of a vertical jump measurement device constructed in accordance with the present invention.

Referring to the drawings in detail, FIG. 1 shows a perspective view of a preferred embodiment of a vertical jump measuring device 10 constructed in accordance with the present invention.

The device 10 includes a mat 12 which could be easy to transport or more heavy-duty for long-term operation in a single location. In a preferred portable embodiment, the entire device weighs less than three pounds, while the heavy-duty version would be heavier. The particular structure of the device would, of course, be a matter of choice within the confines of the invention.

The dimensions of the mat will be variable, although a jumper will easily be able to fit both feet on the mat 12. In one embodiment, the mat will be no thicker than ¼ inch to 1 inch. The mat 12 may be flexible so that it can be rolled up after use for storage or transportation.

An electrical conducting cable 14 may extend from the mat 12 and terminate in a control box 40. Alternately, wireless communication between the mat and indicator could be employed.

Figure 2:
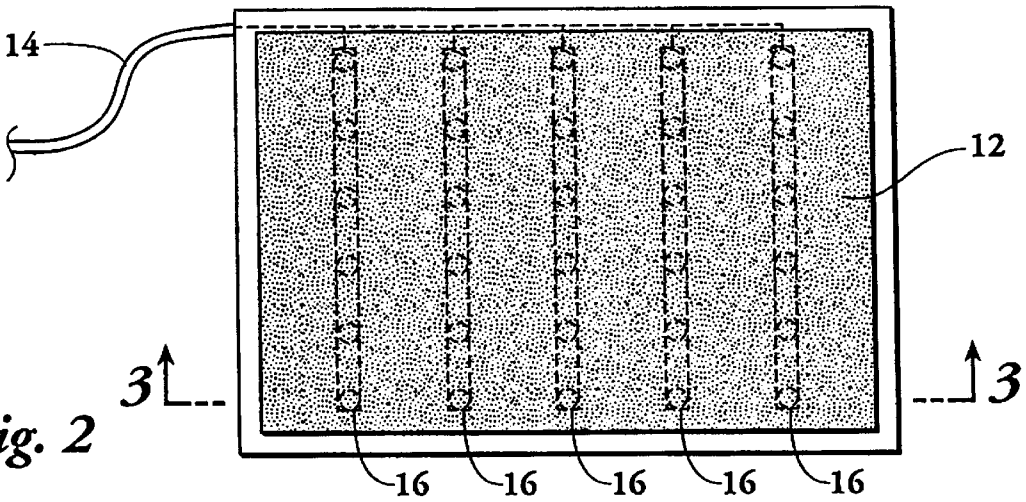
FIG. 2 is a top view of a portable mat which is a part of the jump measurement device shown in FIG. 1.
Figure 3:
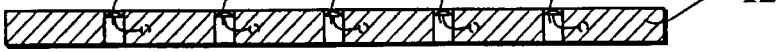
FIG. 3 is a sectional view taken along section line 3—3 of FIG. 2.

FIG. 2 shows a top view of the mat 12 shown in FIG. 1 and FIG. 3 shows a cross-sectional view of the portable mat 12.

Embedded within the mat 12 are a matrix of proximity sensors (shown in dashed line form in FIG. 2). In the embodiment shown, An array of button switches might be employed or ends of photo-optical or ultrasonic proximity detectors.

As seen in FIG. 2, the sensors 16 are distributed over the mat. The number and spacing of transducers is a matter of choice although there will be enough locations so that contact between a jumper's foot and the mat will be sensed by at least one. As will be explained in detail, the transducers are wired together in parallel.

The sensors could be switches that are normally open and close in response to contact with the feet. Alternatively, the switches could be normally closed and open as a result of contact.

Figure 4:
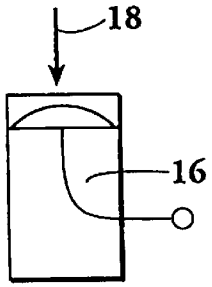
FIG. 4 is a proximity transducer shown apart from the portable mat of the vertical jump measurement device of the present invention.

FIG. 4 shows an enlarged view of one of the proximity sensors 16 apart from the mat 12. The bottom of the foot will be detected when it makes contact with the upper surface of the sensor or moves away from the sensor.

Activating any one of the proximity sensors 16 will send an electrical voltage signal through the circuit and through the cable 14.

Figure 5:
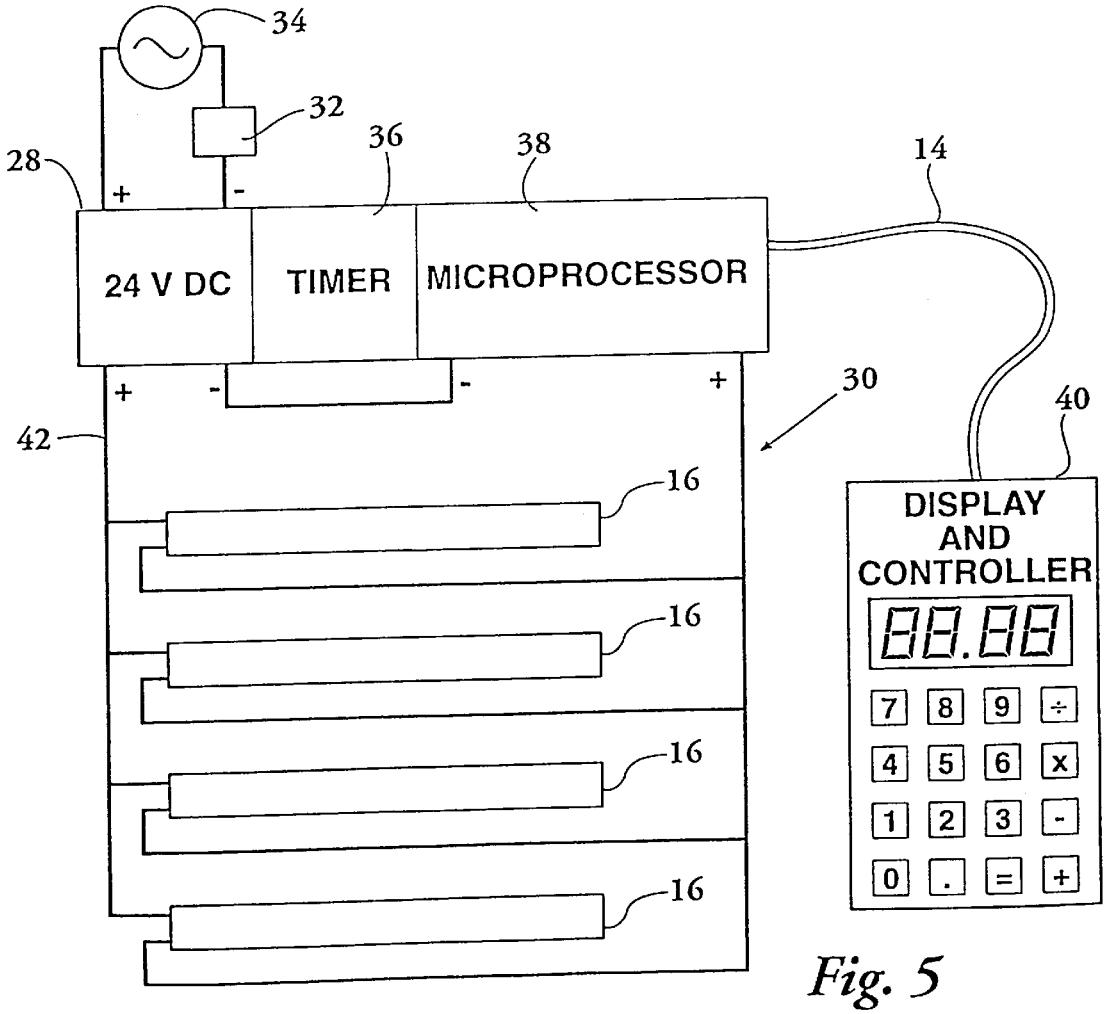
FIG. 5 is a simplified circuit diagram of the jump measurement device shown in FIG. 1.

FIG. 5 illustrates a simplified circuit diagram 30 of the portable, vertical jump measuring device 10 of the present invention. A matrix (or array) of the proximity sensors 16 are shown wired in parallel. Accordingly, activating any one or more of the sensors 16 will induce a voltage change through the circuit.

The circuit 30 may include an optional ON/OFF switch 32 to terminate power. Power to the circuit is shown at reference numeral 34 and may be in the form of battery power or, alternatively, alternating current wired to a transformer 28 to convert to low voltage direct current. In the present embodiment, normal 120 volt, 60 Hz alternating current (AC) is converted to 24 volt direct current (DC). The circuit 30 includes a timer 36 connected to a microprocessor 38. The microprocessor 38 is, in turn, connected to a display and controller 40 which will be contained within the control box 16. In the embodiment shown, the display and controller 40 is connected by cable 14 although wireless technology might be employed.

As seen in FIG. 5, voltage from the transformer 28 passes via wire 42 through each of the pressure sensitive switches and thereafter to the microprocessor 38. This is represented as the positive side (+) of the circuit.

The negative side of the circuit (−) passes from the microprocessor 38 back to the transformer 28. The timer is connected to both the transformer 28 for power supply and to the microprocessor 38.

The display and controller 40 will display the resultant vertical height of the jump after calculation.

Figure 6:
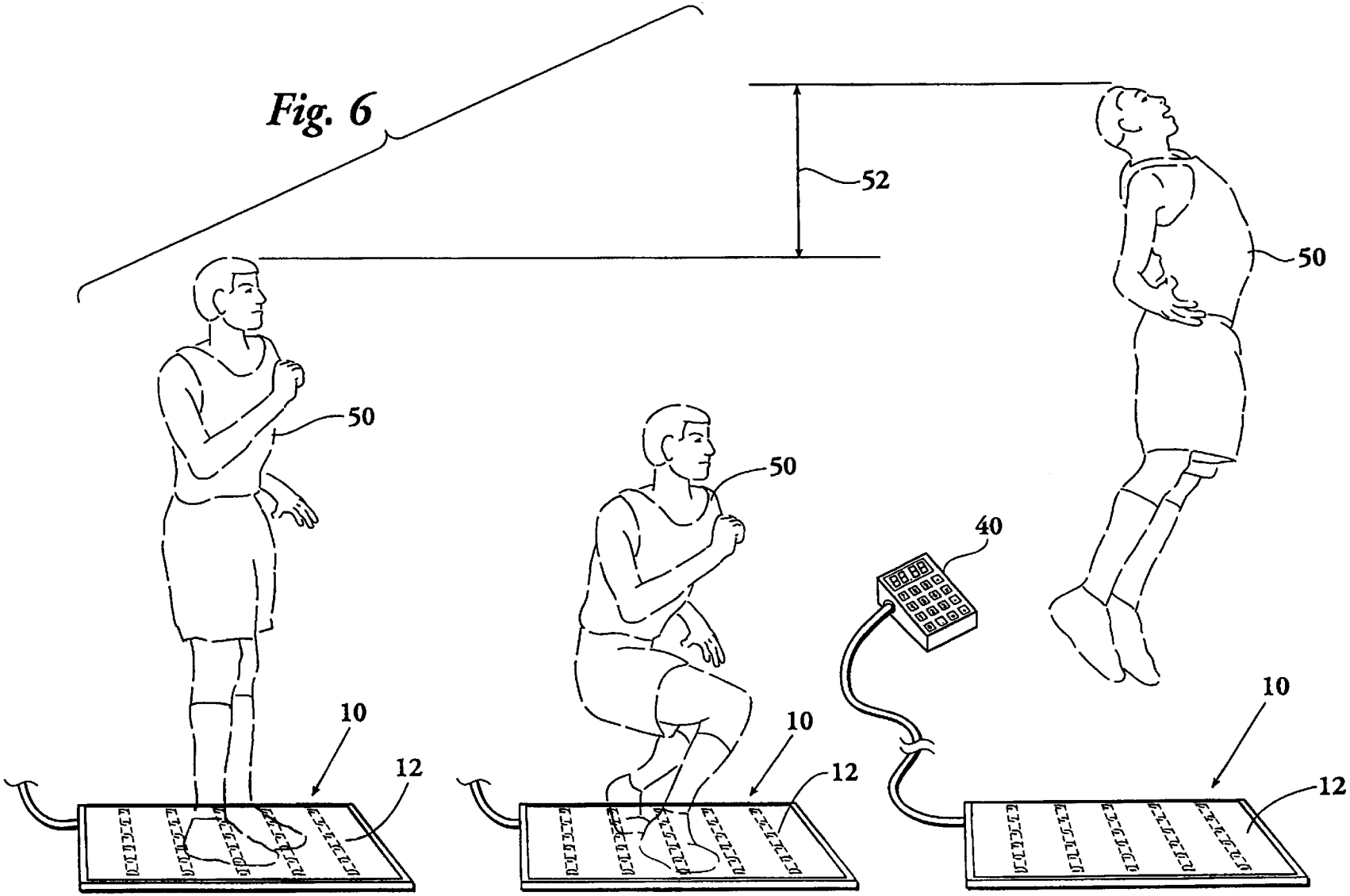
FIG. 6 is a sequential view of a jumper (shown by dashed lines) using the jump measurement device of the present invention.

FIG. 6 shows the sequential process as a jumper 50 or other athlete utilizes the jump measuring device 10 to determine vertical jump height. FIG. 6 shows three stages of a jump depicted from left to right.

As seen in the first stage in FIG. 6, the jumper will start with both feet on the mat 12 in a standing, upright position. To begin the jump, the jumper 50 will first bend his or her knees and lower the body as seen in the second stage.

Thereafter, the jumper will jump to his or her maximum height as seen in the final stage in the sequence shown in FIG. 6. When the jumper leaves the mat, the timer will begin. The arrow 52 shows the total vertical jump of the jumper. The timer will continue counting until the jumper returns to the mat (not seen in FIG. 6).

When a person jumps, the center mass of the body is first lowered, then propelled upward with leg strength. At the instant the jumper's feet leave the ground, the center of mass is moving upward at a velocity of $V_0$. While in the air, the person is accelerating downward (or decelerating) at a constant value given by the letter g (the acceleration due to gravity). The direction of velocity changes after the top position of the jump, and, thus, deceleration is followed by acceleration.

For this motion, if the person's initial height is taken as zero prior to the jump (while standing straight and still), then the vertical position, y, of the center of gravity can be described as a function of time, t, by the equation:

$$y = V_o t - \frac{1}{2} g t^2 \qquad \text{Equation 1}$$

(In this example, wind resistance is neglected). This equation can be used to define the time at which the mass raises to its maximum height, then returns to its original height of zero (by setting y=0). This leads to the equation:

$$V_o = \frac{gt}{2} \qquad \text{Equation 2}$$

The height of the jump can be directly related to the initial velocity using conservation of energy considerations. The initial kinetic energy, $E_k$, of the person at the instant the feet leave the ground is:

$$E_K = \frac{1}{2} m V_o^2 \quad \text{Equation 3}$$

where m is the mass of the person making the jump. At the peak height of the jump, the vertical speed diminishes to zero, and the change in gravitational potential energy is maximized due to the increase in the person's height to a value of h. The gravitational potential energy, $E_g$, is related to the change in height from the relation:

$$E_g = mgh \quad \text{Equation 4}$$

Setting equation 3 equal to equation 4.

$$V_o = \sqrt{2gh} \quad \text{Equation 5}$$

Setting equation 5 equal to equation 2, then the final relation between the time the feet are in the air, t, and the height of the jump, h, is given by:

$$h = \frac{gt^2}{8} \quad \text{Equation 6}$$

Assuming g=386.4 in/s$^2$, the jump height is obtained in units of inches by squaring the time, t, in seconds and multiplying by the constant 48.265. Thus, the final equation is:

$$h = 48.2625t^2 \quad \text{Equation 7}$$

The height could easily be obtained in other units (e.g., centimeters) with standard metric conversion factors.

It will be understood that the switches might be wired in reverse fashion and still achieve the objects of the invention. For example, with normally closed switches, the device could be configured to measure the time the switch is closed.

While the foregoing has been described with respect to measuring a standing jump, the device 10 could also be used to measure a running jump.

The key pad could include a command to reset the circuit and timer, so that a new jump could be measured. Alternatively, the microprocessor could include a command to reset once a jumper stepped on the mat.

Figure 7:
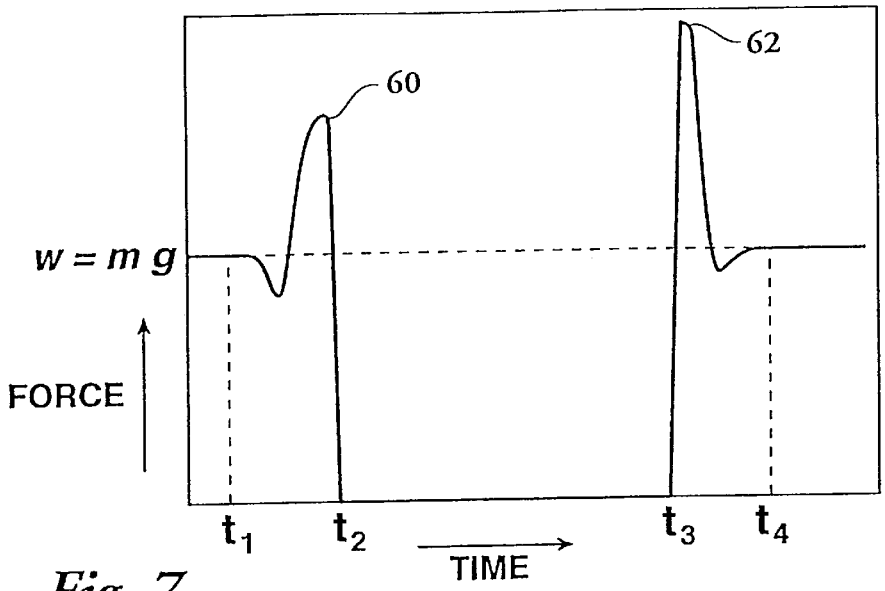
FIG. 7 is a chart illustrating force and time parameters to illustrate the measurement of forces during take off and landing for an alternate embodiment of the present invention.

An alternate process and device may be used to calculate the vertical jump height of a jumper. As seen in FIG. 7, by measuring the force of take-off and landing of a jumper, the vertical height of a jump can be derived.

If the matrix of sensors in the floor mat 12 of the embodiment in FIGS. 1–6 were replaced with a calibrated force measurement device (like a scale) then the force versus time data exerted by the feet of the jumper on the mat during take-off and landing could be processed to provide three independent measures of jump height. In the alternate process and device, the force measurement device would be embedded in the mat.

Referring to FIG. 7, a take-off impulse 60 and landing impulse 62 are evident. This force versus time profile, which would be recorded digitally with data acquisition hardware and software, provides three independent measurements of the height of the jump: (1) the time from t2 to t3 (t=t3−t2) can be used in equation 6 exactly as described previously. (2) the impulse (defined as the area under the force versus time curve) for take-off from t1 to t2 can be used with the principle of impulse and momentum to define the upward velocity of the jumper, $V_o$, exactly at time=t2, and used with equation 5 to compute height. (3) similarly, the impulse at landing from t3 to t4 can be used to compute the velocity of the feet just prior to landing at time=t3 and again used with equation 5 to compute height. The heights computed from the impulse relations should differ only by the difference in the height of the jumper's center of gravity at t2 and t3. (That is, if the legs are slightly bent at landing, a slightly higher final velocity could be computed).

As depicted in FIG. 7, the magnitude of the maximum force for the landing pulse could be considerably higher than that for take-off. However, the duration of the force spike will be shorter, such that the impulse 62 (the area under the curve) from the taller, narrower landing curve is identical to the shorter, wider take-off impulse 60.

When computing the impulses acting on the jumper from time t1 to tf, both the force on the jumper's feet, F (as measured by the transducer in the mat), and the constant gravitational force acting on the jumper's center of gravity (w=mg) must be considered, as in equation 6.

$$\int_{t_i}^{t_f} F\,dt - w(t_f - t_i) = \left(\frac{w}{g}\right)(V_f - V_i) \quad \text{Equation 8}$$

For the take-off impulse, $t_i = t_f = t_2$. The initial velocity is zero and final velocity, $V_f$, is the jumper's take-off velocity, which is positive (upward). For the landing impulse, $t_i = t_3$ and $t_4$. The initial velocity, $V_i$, is the jumper's landing velocity, which is negative (downward), and the final velocity is zero. The velocities are used to compute height with equation 6.

The resultant vertical jump height could be displayed on a digital display similar to that shown in the embodiment in FIGS. 1–6.

The force versus time data contained in the take-off impulse could be used by therapists and athletic trainers to analyze a jumper's technique. Specialized drills and exercises could be prescribed, based on the take-off impulse, specifically to improve jump height. Using the device, the effectiveness of these exercises could be quantitatively assessed.

Figure 8:
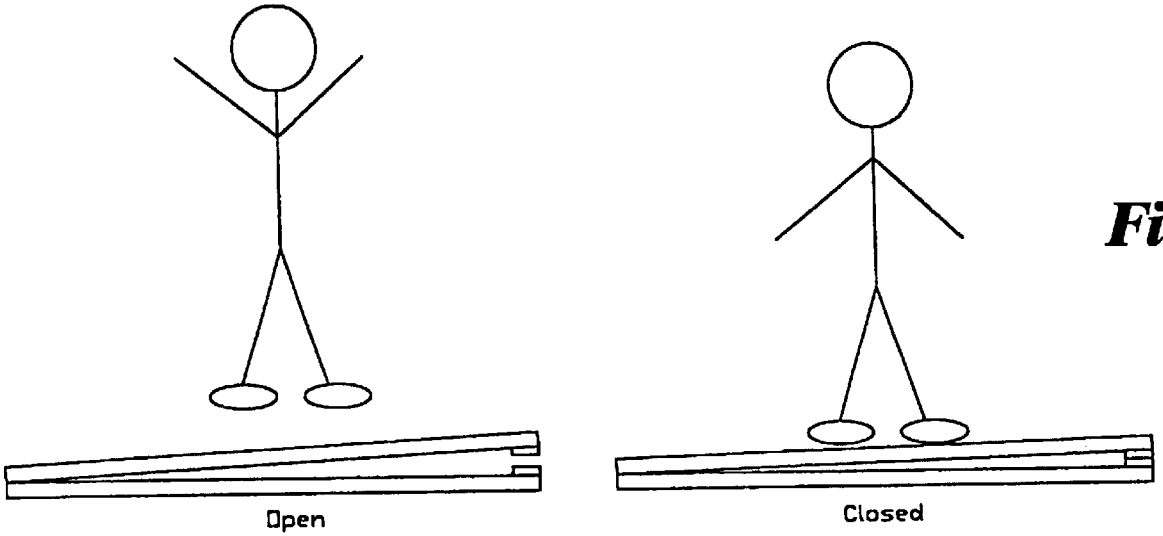
FIGS. 8 and 9 illustrate simplified sketches of possible methods to activate and deactivate transducers or switches in response to a jumper.
Figure 9:
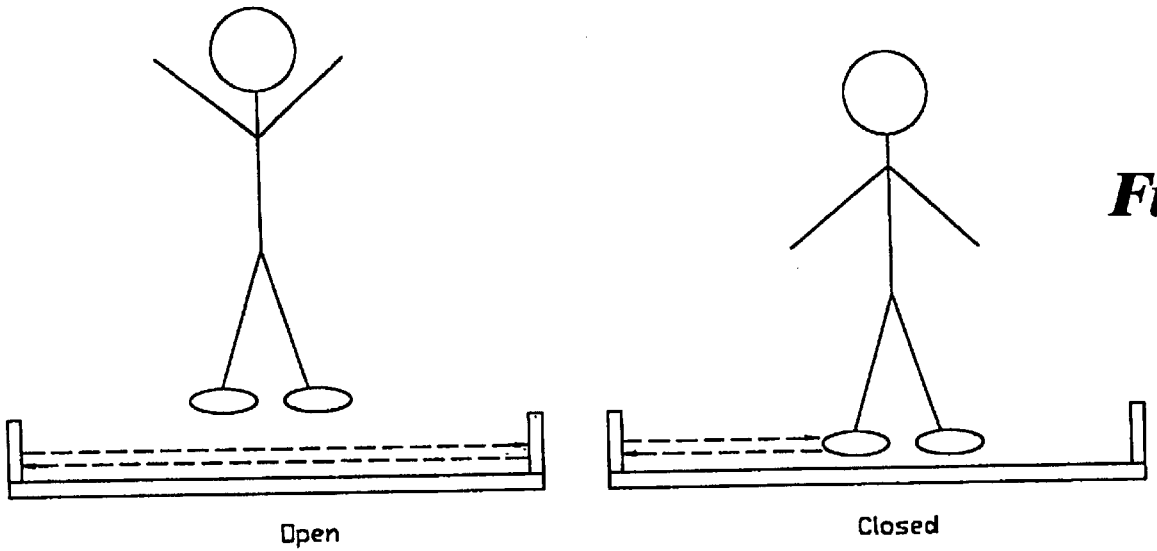

FIGS. 8 and 9 illustrate simplified sketches of possible methods to activate and deactivate transducers or switches in response to a jumper. The approaching FIG. 8 has been documented above. In FIG. 9, a photo-optical or ultrasonic proximity detector might be used with the present invention.

With reference to FIG. 10, the calculation or even a more sophisticated calculation could be used to develop a "look up" table of heights for a measured time period. If the time period is measured in units of thousands of a second, by way of example, then a matrix of only a few thousand height values would need to be stored in a data base. This could be done in a computer data base. A look up table, such as shown in FIG. 10, could be computed from such an equation or from empirical data collected by repeated performance of the jump. This could be done by jumping in front of a video camera with a calibrated background or even jumping and hitting a conventional shim arrangement or other device. Experimentally obtained data could be used to create such a look up table.

In one embodiment, after the time was sensed, a comparison could be made in the look up table to determine the height.

Whereas, the present invention has been described in relation to the drawings attached hereto, it should be understood that other and further modifications, apart from those shown or suggested herein, may be made within the spirit and scope of this invention.

What is claimed is:

1. A method to measure vertical jump height of a jumper, which method comprises:

measuring both take-off impulse force over a period of time and landing impulse force over a period of time of a jump of said jumper;

measuring a time period between take-off and landing;

converting said impulse force and time periods measurements into upward and downward velocities by integrating force over said time measurements;

calculating vertical jump height from said velocities; and displaying said vertical jump height.

2. A method to measure vertical jump height of a jumper as set forth in claim 1 including the additional step of measuring said time period with a plurality of transducers.

3. A vertical jump measuring device, which comprises:

at least one normally open transducer adapted to deliver a signal and deactivated in response to a jumper stepping thereon;

a timer connected to said transducer and adapted to receive said signal to measure a time period said transducer is activated while said jumper is in the air;

a table which derives vertical height jumped from impulse force and time period measurements;

means to display the resultant vertical height jumped from said table; and an output device connected to said means to display the resultant vertical jump height of said jumper obtained from said table.

4. A vertical jump measuring device as set forth in claim 3 wherein said table is stored in a microprocessor database.

5. A vertical jump measuring device as set forth in claim 3 wherein said table is empirically developed.

6. A vertical measuring device, which comprises:

at least one normally closed transducer adapted to deliver a signal and activate response to a jumper stepping thereon;

a timer connected to said transducer and adapted to receive said signal to measure a time period said transducer is deactivated while said jumper is in the air;

a table which derives vertical height jumped from impulse force and time period measurements;

means to display the resultant vertical height jumped; and an output device connected to said means to display the resultant vertical jump height of said jumper obtained from said table.

7. A vertical jump measuring device as set forth in claim 6 wherein said table is stored in a microprocessor database.

8. A vertical jump measuring device as set forth in claim 6 wherein said table is empirically developed.

9. A vertical jump measuring device, which comprises:

at least one normally open transducer adapted to deliver a signal and deactivated response to a jumper stepping thereon;

at timer connected to said transducer and adapted to receive said signal to measure time period said transducer is activated while said jumper is in the air;

a table which derives vertical height jumped by calculating the square of the time period the jumper is in the air and thereafter multiplying the result by a constant;

means to display the resultant vertical height jumped from said table; and an output device connected to said means to display the resultant vertical jump height of said jumper obtained from said table.

10. A vertical jump measuring device, which comprises:

at least one normally closed transducer adapted to deliver a signal and activated in response to a jumper stepping thereon;

a timer connected to said transducer and adapted to receive said signal to measure a time period said transducer is deactivated while said jumper is in the air, a table which derives vertical height jumped by calculating the square of the time period the jumper is in the air and thereafter multiplying the result by a constant;

means to display the resultant vertical height jumped; and an output device connected to said means to display the resultant vertical jump height of said jumper obtained from said table.

* * * * *

UNITED STATES PATENT AND TRADEMARK OFFICE

CERTIFICATE OF CORRECTION

PATENT NO 6,181,647
DATED January 30, 2001
INVENTOR(S) : STEVEN M. TIPTON, MATT HACKWORTH and KELLYWILLSON It is certified that error appears in the above-identified patent and that said Letters Patent is hereby corrected as shown below:

Column 7, Line 10, after "grating" insert –said–;

Column 7, line 38, delete the word "activate" and insert –activated in–;

Column 8, line 13, after "deactivated" insert –in–;

Column 8, line 15, the word "at" should be –a–;

Column 8, line 16, after "measure" insert –a–;

Column 8, line 33, delete "," and insert –;–.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*